US007674188B2

(12) United States Patent
Ban

(10) Patent No.: US 7,674,188 B2
(45) Date of Patent: Mar. 9, 2010

(54) GOLF CLUB HEAD

(75) Inventor: Wataru Ban, Chichibu (JP)

(73) Assignee: Bridgestone Sports Co, Ltd., Tokyo (JP)

( * ) Notice: Subject to any disclaimer, the term of this patent is extended or adjusted under 35 U.S.C. 154(b) by 81 days.

(21) Appl. No.: 11/941,530

(22) Filed: Nov. 16, 2007

(65) Prior Publication Data

US 2008/0125243 A1 May 29, 2008

(30) Foreign Application Priority Data

Nov. 28, 2006 (JP) ..... 2006-320751

(51) Int. Cl.
*A63B 53/04* (2006.01)

(52) U.S. Cl. ..... 473/330; 473/331

(58) Field of Classification Search ..... 473/324–350, 473/287–292

See application file for complete search history.

(56) References Cited

U.S. PATENT DOCUMENTS

| | | | |
|---|---|---|---|
| 1,289,553 | A | 12/1918 | Sanders |
| 1,337,958 | A | 4/1920 | Reach |
| 1,965,954 | A | 7/1934 | Davis |
| 2,005,401 | A | 6/1935 | Storz |
| D190,035 | S | 4/1961 | Hansen |
| 3,693,978 | A | 9/1972 | East |
| 4,067,572 | A | 1/1978 | Coleman |
| 4,413,825 | A | 11/1983 | Sasse |
| 4,753,440 | A | 6/1988 | Chorne |
| 4,858,929 | A | 8/1989 | Long |
| 4,957,294 | A | 9/1990 | Long |
| 5,029,864 | A | 7/1991 | Keener |
| 5,100,144 | A | 3/1992 | Okumoto et al. |
| 5,437,088 | A | 8/1995 | Igarashi |
| 5,591,092 | A | 1/1997 | Gilbert |
| 5,637,044 | A | 6/1997 | Swash |
| 5,688,186 | A | 11/1997 | Michaels et al. |
| 5,709,616 | A | 1/1998 | Rife |
| 5,744,780 | A | 4/1998 | Chang et al. |
| 5,766,087 | A | 6/1998 | Kawamatsu |
| 5,766,097 | A | 6/1998 | Horiuchi et al. |
| 5,785,610 | A | 7/1998 | Birmingham |
| 5,788,584 | A * | 8/1998 | Parente et al. ..... 473/290 |
| 6,733,400 | B2 | 5/2004 | Sherwood |

(Continued)

FOREIGN PATENT DOCUMENTS

| | | |
|---|---|---|
| JP | 02-026574 | 1/1990 |

(Continued)

OTHER PUBLICATIONS

European Search Report; GB 0723019.6; Mar. 25, 2008.

(Continued)

*Primary Examiner*—Sebastiano Passaniti
(74) *Attorney, Agent, or Firm*—Paul, Hastings, Janofsky & Walker LLP

(57) ABSTRACT

A golf club head of this invention includes a face, a plurality of score line grooves formed on the face, and traces formed in the face by milling. Edges of the score line grooves are rounded with a radius of not more than 0.2 mm. A width W (mm) of the score line groove measured with the rounded edge being included, a width Ws (mm) between the score line grooves adjacent to one another, a width Wr (mm) of the score line groove measured based on the 30 degrees measurement rule and a cross section area S ($mm^2$) of the score line grooves satisfy the flowing expressions; $W/Ws \times 100 \geqq 35(\%)$ and $S/(Wr \times 0.5) \times 100 \geqq 70(\%)$. The face in which the traces are formed has the arithmetic mean deviation of the profile (Ra) of not less than 4.00 μm.

5 Claims, 14 Drawing Sheets

U.S. PATENT DOCUMENTS

| | | | | |
|---|---|---|---|---|
| 6,814,673 | B2 | 11/2004 | Wahl et al. | |
| 6,849,004 | B2 | 2/2005 | Lindsay | |
| 6,981,923 | B2 | 1/2006 | Chappell | |
| 7,014,568 | B2 * | 3/2006 | Pelz | 473/287 |
| 7,056,226 | B2 | 6/2006 | Kennedy | |
| 7,066,833 | B2 | 6/2006 | Yamamoto | |
| 7,156,751 | B2 | 1/2007 | Wahl et al. | |
| 7,159,292 | B2 * | 1/2007 | Suzuki et al. | 29/402.01 |
| 7,166,039 | B2 | 1/2007 | Hettinger et al. | |
| 7,179,175 | B2 | 2/2007 | Kennedy, III | |
| 7,192,361 | B2 | 3/2007 | Gilbert et al. | |
| 7,258,627 | B2 | 8/2007 | Chappell | |
| 7,275,999 | B2 | 10/2007 | Sherwood | |
| 7,285,057 | B2 | 10/2007 | Mann, Jr. et al. | |
| 7,327,017 | B2 * | 2/2008 | Sirinorakul et al. | 257/666 |
| 2002/0016218 | A1 | 2/2002 | Takeda | |
| 2002/0042306 | A1 | 4/2002 | Chappell | |
| 2002/0132683 | A1 | 9/2002 | Buchanan | |
| 2003/0008724 | A1 | 1/2003 | Griffin | |
| 2004/0087387 | A1 | 5/2004 | Wahl et al. | |
| 2005/0037859 | A1 | 2/2005 | Gilbert et al. | |
| 2005/0075191 | A1 | 4/2005 | Bennett | |
| 2005/0130761 | A1 | 6/2005 | Vokey et al. | |
| 2005/0143187 | A1 | 6/2005 | Kennedy | |
| 2006/0003851 | A1 | 1/2006 | Chappell | |
| 2006/0154739 | A1 | 7/2006 | Mann, Jr. et al. | |
| 2006/0223648 | A1 | 10/2006 | Kennedy, III | |
| 2007/0010346 | A1 | 1/2007 | Gilbert et al. | |
| 2007/0149312 | A1 | 6/2007 | Gilbert | |
| 2008/0020859 | A1 | 1/2008 | Yamagishi et al. | |
| 2008/0032814 | A1 | 2/2008 | Ban | |
| 2008/0051212 | A1 | 2/2008 | Voges | |
| 2008/0102981 | A1 | 5/2008 | Nguyen et al. | |
| 2008/0108453 | A1 | 5/2008 | Park et al. | |
| 2008/0125242 | A1 | 5/2008 | Ban | |
| 2008/0132351 | A1 | 6/2008 | Ban et al. | |
| 2008/0132352 | A1 | 6/2008 | Ban | |
| 2008/0167138 | A1 | 7/2008 | Ban et al. | |
| 2008/0242442 | A1 | 10/2008 | Gilbert et al. | |
| 2009/0011852 | A1 | 1/2009 | Solheim et al. | |
| 2009/0029797 | A1 | 1/2009 | Ban et al. | |
| 2009/0036228 | A1 | 2/2009 | Ban et al. | |
| 2009/0082129 | A1 | 3/2009 | Ban et al. | |

FOREIGN PATENT DOCUMENTS

| | | | |
|---|---|---|---|
| JP | 2026574 | A | 1/1990 |
| JP | 08-000777 | A | 1/1996 |
| JP | 08-229169 | A1 | 10/1996 |
| JP | 09-70457 | A | 3/1997 |
| JP | 09-192274 | A | 7/1997 |
| JP | 09-253250 | A | 9/1997 |
| JP | 10-015116 | A | 1/1998 |
| JP | 10-179824 | | 7/1998 |
| JP | 10-197824 | A | 7/1998 |
| JP | 10-248974 | | 9/1998 |
| JP | 09-308714 | A | 12/1998 |
| JP | 09-308715 | A | 12/1998 |
| JP | 2001170227 | A | 6/2001 |
| JP | 2001-178856 | A | 7/2001 |
| JP | 2002-224250 | A | 8/2002 |
| JP | 2002291949 | A | 10/2002 |
| JP | 2003-093560 | A | 4/2003 |
| JP | 2002-126135 | A | 6/2005 |
| JP | 2005-169129 | A | 6/2005 |
| JP | 2005-287534 | A | 10/2005 |
| JP | 2007202633 | A | 8/2007 |
| JP | 2008005994 | A | 1/2008 |
| JP | 2008-079969 | A | 4/2008 |
| WO | 0002627 | A1 | 1/2000 |
| WO | 0074799 | A1 | 12/2000 |
| WO | 0197924 | A1 | 12/2001 |
| WO | 03045507 | A1 | 6/2003 |

OTHER PUBLICATIONS

European Search Report; GB0723020.4; Mar. 27, 2008.

* cited by examiner

FIG. 8

| | SPECIFICATIONS OF SCORE LINE GROOVES | | | | | | | | | | TEST RESULTS | | | |
|---|---|---|---|---|---|---|---|---|---|---|---|---|---|---|
| | ANGLE θ1 (°) | ROUNDING RADIUS (mm) | WIDTH W (mm) | RULE-BASED WIDTH Wr (mm) | WIDTH BETWEEN GROOVES Ws (mm) | PITCH (mm) | GROOVED AREA RATIO (%) | GROOVE DEPTH D (mm) | CROSS SECTION AREA S (mm2) | CROSS SECTION AREA RATIO (%) | DEGREE OF SCRATCHES | SPIN AMOUNT (rpm) DRY | SPIN AMOUNT (rpm) WET | RULE CONFORMANCE |
| #1 | 15 | 0 | 0.90 | 0.90 | 8.60 | 9.50 | 10 | 0.50 | 0.417 | 93 | 6 | 10532 | 3266 | ○ |
| #2 | | | | | 2.70 | 3.60 | 33 | | | | 8 | 9610 | 7130 | |
| #3 | | | | | 1.35 | 2.25 | 67 | | | | 10 | 8760 | 9841 | × |
| #4 | 30 | 0.1 | 1.00 | 0.90 | 4.00 | 5.00 | 25 | | 0.339 | 75 | 3 | 10100 | 2400 | ○ |
| #5 | | | 0.55 | 0.45 | 1.25 | 1.80 | 44 | | 0.134 | 59 | 6 | 9400 | 1800 | |
| #6 | | 0.2 | 0.80 | 0.60 | 1.60 | 2.40 | 50 | | 0.189 | 63 | 3 | 9350 | 2700 | |
| #7 | | | 0.65 | 0.45 | 1.15 | 1.80 | 57 | | 0.114 | 50 | 4 | 9150 | 2100 | |
| #11 | 30 | 0.1 | 1.00 | 0.90 | 2.60 | 3.60 | 38 | 0.50 | 0.339 | 75 | 4 | 9800 | 4500 | ○ |
| #12 | | | 0.85 | 0.75 | 2.15 | 3.00 | 40 | | 0.284 | 76 | | 9720 | 5000 | |
| #13 | | | 0.70 | 0.60 | 1.70 | 2.40 | 41 | | 0.209 | 70 | | 9600 | 4000 | |
| #14 | | 0.2 | 1.10 | 0.90 | 2.50 | 3.60 | 44 | | 0.339 | 75 | 1 | 9650 | 4800 | |
| #15 | | | 0.95 | 0.75 | 2.05 | 3.00 | 46 | | 0.264 | 70 | 2 | 9500 | 4000 | |

FIG. 10

| | SPECIFICATIONS OF STRIATION | | TEST RESULTS | |
|---|---|---|---|---|
| | θ0 (°) | Ra (μm) | SPIN AMOUNT (rpm) | |
| | | | NORMAL | OPEN |
| # 21 | 67 | 4.4 | 6600 | 7200 |
| # 22 | 45 | | 6500 | 7300 |
| # 31 | 90 | 0.5 | 3000 | 3500 |
| # 32 | | 2.0 | 3300 | 3900 |
| # 33 | | 3.0 | 4000 | 4500 |
| # 34 | | 4.0 | 5700 | 6200 |
| # 35 | | 4.4 | 6450 | 6900 |
| # 36 | 23 | | 6000 | 7000 |
| # 37 | 0 | | 5600 | 6600 |

FIG. 12A

| | SPECIFICATIONS OF SCORE LINE GROOVES | | | | | | | | | | MILLING | Ra (μm) |
|---|---|---|---|---|---|---|---|---|---|---|---|---|
| | ANGLE θ1 (°) | ROUND-ING RADIUS (mm) | WIDTH W (mm) | RULE-BASED WIDTH Wr (mm) | GROOVE DEPTH D (mm) | WIDTH BETWEEN GROOVES Ws (mm) | PITCH (mm) | GROOVED AREA RATIO (%) | CROSS SECTION AREA S (mm2) | CROSS SECTION AREA RATIO (%) | | |
| COMPARATIVE EXAMPLE 1 | 30 | 0 | 0.90 | 0.90 | 0.50 | 2.7 | 3.60 | 33 | 0.383 | 85 | NOT PERFORMED | 0.4 |
| COMPARATIVE EXAMPLE 2 | | | | | | | | | | | PERFORMED | 4.4 |
| COMPARATIVE EXAMPLE 3 | | 0.1 | 1.00 | | | 3.0 | 4.00 | | 0.339 | 75 | NOT PERFORMED | 0.4 |
| EXAMPLE | | | | | | 2.6 | 3.60 | 38 | | | PERFORMED | 4.4 |

FIG. 12B

| | TEST RESULTS | | |
|---|---|---|---|
| | DEGREE OF SCRATCHES | SPIN AMOUNT (rpm) | |
| | | FAIRWAY | ROUGH |
| COMPARATIVE EXAMPLE 1 | △ | 9610 | 7130 |
| COMPARATIVE EXAMPLE 2 | × | 9300 | 7800 |
| COMPARATIVE EXAMPLE 3 | ◎ | 9700 | 5800 |
| EXAMPLE | ○ | 9100 | 8200 |

GOLF CLUB HEAD

BACKGROUND OF THE INVENTION

1. Field of the Invention

The present invention relates to a golf club head.

2. Description of the Related Art

The face of a golf club head include a plurality of grooves, known as marking lines, score lines, or face line grooves (hereinafter referred to as score line grooves), which affect the spin amount on a ball. It is desirable to have the grooves on an iron club head, especially a wedge, in order to increase the spin amount on the ball. The surface roughness of the face also influences the spin amount of a ball.

Japanese Patent Laid-Open No. 9-192274 discloses a golf club having score line grooves of V-shaped or trapezoidal cross section. Japanese Patent Laid-Open No. 9-70457 and No. 10-179824 disclose a golf club head having score line grooves edges (boundary portions between side surfaces of the grooves and a face) of which are rounded. This rounding has an effect of preventing a golf ball from getting damaged (for example, scratches and the like). Japanese Patent Laid-Open No. 2003-93560 and No. 2005-287534 disclose a golf club head having score line grooves each of which has a side surface formed not by a single surface, but by two differently angled surfaces. In Japanese Patent No. 3463779, a set of iron type golf clubs each of which has an area ratio of the score line grooves to the face set differently depending on its own type number of golf clubs is disclosed. Incidentally, a golf club head used in the official games is subject to constraints on a width and depth of the groove, and a pitch between the adjacent grooves specified in the rules, and therefore, in consideration of applications in the official games, it is required to design a golf club head in a range to meet the rules.

The surface roughness of the face also influences the spin amount of a ball. Japanese Patent Laid-Open No. 2005-169129 discloses a golf club head in which the surface roughness of the face is set to 40 Ra or more. Japanese Patent No. 3000921 discloses a golf club head in which a plurality of fine grooves are formed on the face in addition to the score line grooves. Incidentally, the surface roughness of the face of a golf club head for official competitions is also restricted by rules. Therefore, when an application in official competitions is considered, a golf club head needs to be designed within a range conforming to the rules.

Now, a spin amount of a golf ball in the rain or hitting a shot in the rough tends to be smaller than that with out the rain or hitting on the fairway. A method for prevention of a decrease in the spin amount of a ball includes sharpening the angle of a groove edge. However, a decrease in the angle of the groove edge may cause a ball to be easily damaged. Damage to the ball can be decreased by rounding the edges of the grooves as the golf club head disclosed in Japanese Patent Laid-Open Nos. 9-70457 and 10-179824. In this case, however, the spin amount of the ball also decreases.

SUMMARY OF THE INVENTION

The present invention has been made to solve the above-described conventional problems.

According to the present invention, there is provided a golf club head comprising a face, a plurality of score line grooves formed on the face, and traces formed in the face by milling, wherein edges of the score line grooves are rounded with a radius of not more than 0.2 mm, a width W (mm) of the score line groove measured with the rounded edge being included, a width Ws (mm) between the score line grooves adjacent to one another, a width Wr (mm) of the score line groove measured based on the 30 degrees measurement rule and a cross section area S ($mm^2$) of the score line grooves satisfy the flowing expressions; $W/Ws\times100\geqq35(\%)$ and $S/(Wr\times0.5)\times100\geqq70(\%)$, and the face in which the traces are formed has the arithmetic mean deviation of the profile (Ra) of not less than 4.00 μm.

In this golf club head, rounding of the groove edge with a radius being not more than 0.2 mm prevents a ball from getting damaged. While, setting of "$W/Ws\times100$" given above which is representative of an area ratio of a grooved area in the face and "$S/(Wr\times0.5)\times100$" given above which is representative of an amplitude of the volume of the groove to the values above described, along with balancing between the area ratio of the grooved area and the amplitude of the volume, allows a large decrease in the spin amount of a ball to be avoided in the rain or a shot in the rough.

The arithmetic mean deviation of the profile (Ra) of not less than 4.00 μm in the face by forming the traces allows significantly greater spin through improved friction between the ball and the face.

Further features of the present invention will become apparent from the following description of exemplary embodiments (with reference to the attached drawings).

BRIEF DESCRIPTION OF THE DRAWINGS

FIG. 8 is a table showing the test results obtained by measuring the degrees of damage (scratches) and spin amount of the ball for golf club heads #1 to #7 and #11 to #15 having different score line groove specifications.

FIG. 10 is a table showing the test results obtained by measuring the spin amount of the ball for golf club heads #21, #22, and #31 to #37 having different striation specifications.

FIG. 12A is a table showing the specifications of an example according to the present invention and Comparative Examples 1 to 3.

FIG. 12B is a table showing the test results of the example according to the present invention and Comparative Examples 1 to 3.

DESCRIPTION OF THE EMBODIMENTS

Figure 1:
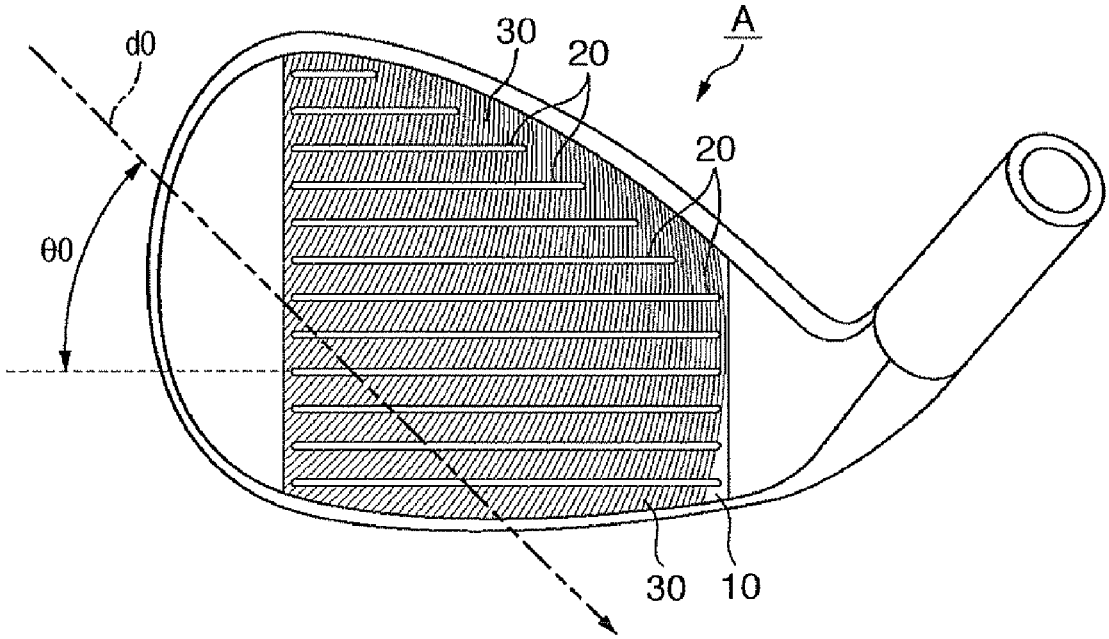
FIG. 1 is an external view of a golf club head A according an embodiment of the present invention.

FIG. 1 is an external view of a golf club head A, according to an embodiment of the present invention. The embodiment depicted in FIG. 1 applies the present invention to an iron club head. The present invention is optimized for club heads for which large spin amount is required, especially wedges such as sand wedges, pitching wedges, or approach wedges. The present invention may also be applied to golf club head for the wood type or the utility type.

The face 10 of the golf club head A comprises a plurality of the score line grooves 20. The face 10 is the surface that strikes the golf ball. According to the embodiment, the respective score line grooves 20 are arrayed in straight lines in the toe-heel direction, all in parallel, with equal pitch between the respective score line grooves 20. The face 10 comprises a plurality of striations 30, which are traces formed by milling.

<Score Line Groove 20>

Figure 2:
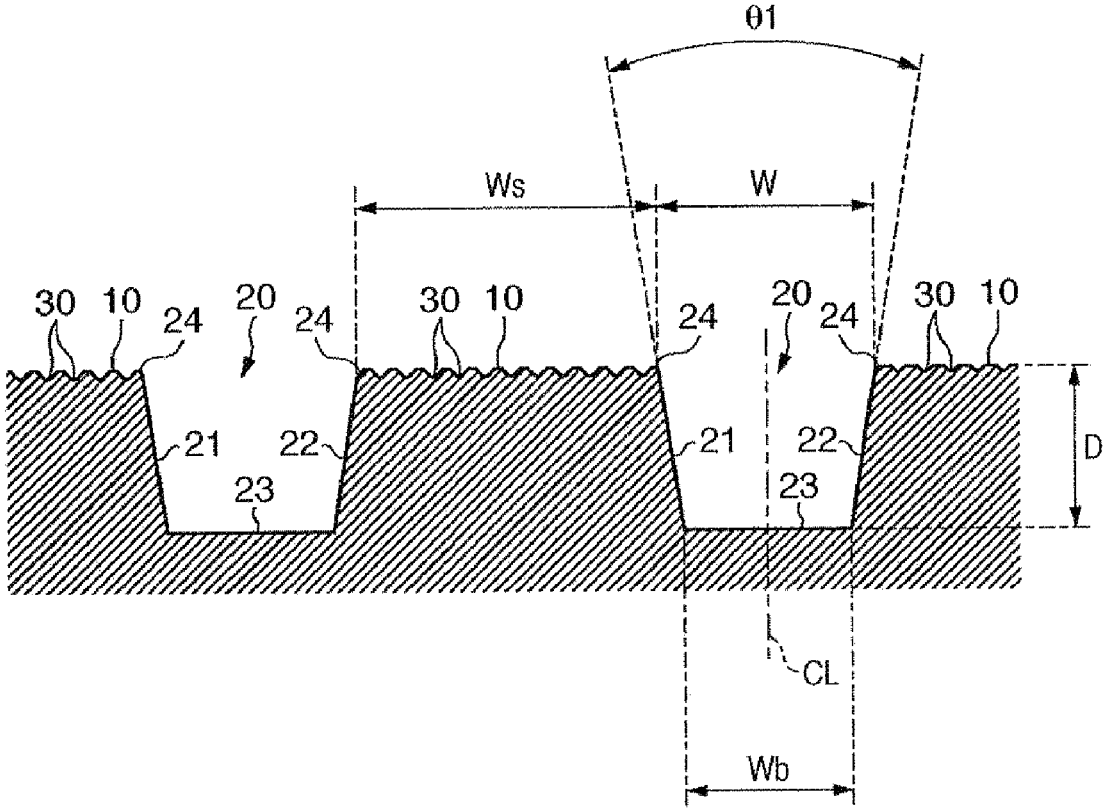
FIG. 2 is a cross-sectional diagram in the vicinity of a score line groove 20 in a direction perpendicular to the longitudinal direction (toe-heel direction).

FIG. 2 is a cross-sectional diagram in the vicinity of a score line grooves 20, which cuts at right angles to the lengthwise, or toe-heel direction, of the score line grooves. In the embodiment, the cross-section of each score line groove 20 is constant in the lengthwise direction, except at the ends. The cross-sections are constant for each score line grooves 20.

The score line groove 20 includes a pair of side surfaces 21 and 22 and a bottom surface 23 and has a trapezoidal cross section. In this embodiment, the sectional shape of the score line groove 20 is symmetric with respect to a center line CL. The pair of the side surfaces 21 and 22 of the score line groove 20 are flat surfaces (the sectional shapes are straight), the upper ends of which continue to the face 10, and the lower ends of which continue to the bottom surface 23. An angle θ1 represents the angle between the side surfaces 21 and 22. The bottom surface 23 is parallel to the face 10. In this embodiment, the sectional shape of the score line groove 20 is a trapezoid. However, it may be a rectangle, square, or triangle.

Edges 24 of the score line grooves 20 are rounded. The radius of the rounding of the edge 24 is 0.2 mm or less. These roundings have an effect of preventing damage (e.g., scratches) to the ball. The radius of the rounding is preferably 0.05 (mm) to 0.1 (mm) (both inclusive).

Figure 3A:
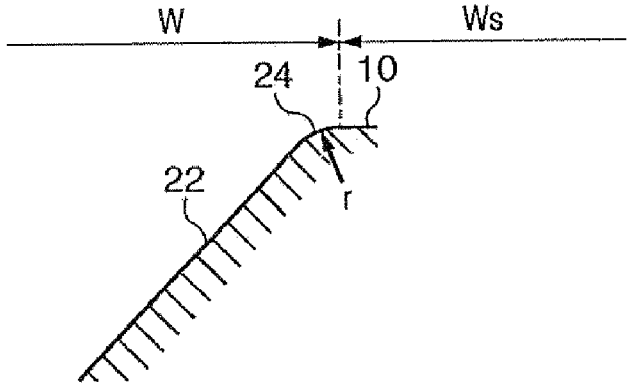
FIG. 3A describes a rounding of the edge of the score line groove 20. score line groove 20 is rounded.

The score line groove 20 has a bottom surface width Wb, a depth D, and a width W. A width Ws is set between the adjacent score line grooves 20. The bottom surface width Wb represents the distance between two ends of the bottom surface 23. The depth D represents the distance from the face 10 to the bottom surface 23. The width W is the width of the score line groove 20 in a direction perpendicular to the longitudinal direction. The width W represents the width measured while including the roundings (radius r) of the edges 24 of the score line groove 20, as shown in FIG. 3A. The width W is measured from a point (a location indicated by the broken line in FIG. 3A) where the rounding starts. The width Ws represents the distance between two points (each of which corresponds to the location indicated by the broken line in FIG. 3A) where the roundings of the adjacent score line grooves 20 respectively start.

Figure 3B:
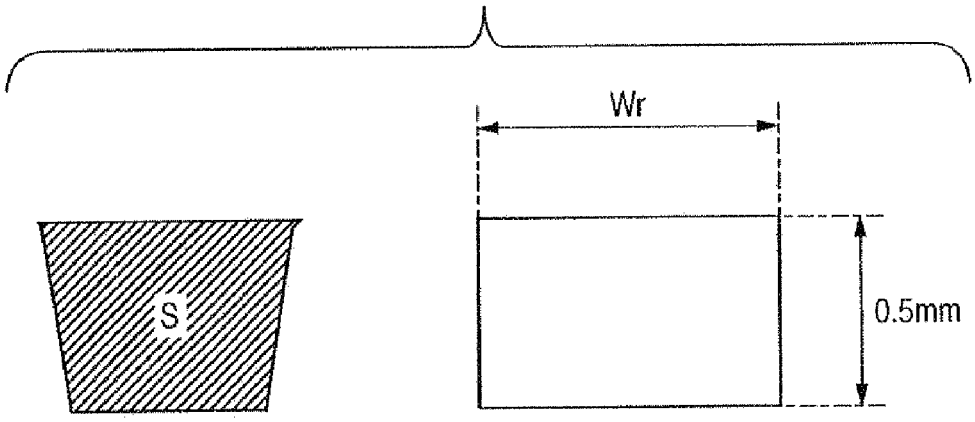
FIG. 3B is a schematic diagram illustrative of a cross section area ratio.
Figure 3C:
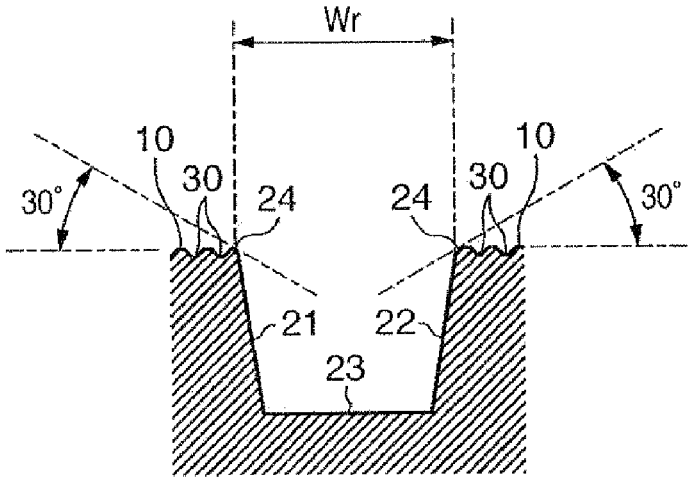
FIG. 3C is a schematic diagram illustrative of the 30 degrees measurement rule.

The term "width of score line groove measured with rounding" used herein means the width W, as measured via the foregoing method, and is differentiated as the width measured via so-called the 30 degrees measurement rule in the R&A regulation which is a method for measuring groove width of a golf club head used for official games. As shown in FIG. 3C, the 30 degrees measurement rule refers to measuring the distance between points on a hypothetical line L, with a 30-degree inclination vis-a-vis the face 10, and that connect the side surfaces 21 and 22, as a width Wr. The width measured by the 30 degrees measurement rule will be referred to hereinafter as the rule-based width. When rounding is applied to the edges of the score line grooves 20, as the embodiment, the width W of the score line groove 20 W may differ from the rule-based width Wr. When rounding is not applied to the edges of the score line groove 20, the width W will equal the rule-based width Wr.

The rule-based width Wr is mandated as being not greater than 0.9 mm. The rules also mandate that the score line grooves depth D is not more than 0.5 mm. In addition, according to the rule, a pitch (the distance between the center lines CL of two grooves) of the grooves is defined to be equal to or larger than "rule-based width" (Wr: mm)×4.

The larger the cross section area of the score line groove 20 gets, the larger the volume of the score line groove 20 gets. The size of the cross section area of the score line groove 20, or to put it another way, a cross section area ratio, is suggested as an indicator that evaluates the volume of the score line groove 20 hereinafter, according to the embodiment. Again, rules for golf club heads used in competition call for the depth D to be not greater than 0.5 mm. Accordingly, when the edges of the score line grooves 20 are not rounded, the maximum cross section area of the score line grooves 20, when the rule-based width Wr applies, is Wr (mm)×0.5 mm=0.5·Wr ($mm^2$), as depicted on the right-hand side of FIG. 3B.

The cross section area ratio of a cross section area S ($mm^2$: see the left part of FIG. 3B) of the score line groove 20 to the maximum cross section area serves as an index to evaluate the volume of the score line groove 20. The cross section area ratio is expressed by:

$$\text{The cross section area ratio}(\%)=S/(Wr\times 0.5)\times 100 \quad (1)$$

Next, an area ratio of a grooved area of the score line groove 20 in the face 10 affects the spin amount of a ball. In this embodiment, an area ratio derived from the following expression (2), as an indicator of the area ratio of the grooved area, will be proposed.

$$\text{The grooved area ratio}(\%)=W/Ws\times 100 \quad (2)$$

In the golf club head 1 of this embodiment, forming the rounding of the edge 24 of the groove 20 with the radius of not more than 0.2 mm prevents a ball from getting damaged. Further, balancing between the grooved area ratio of the groove 20 specified in the expression (2) given above and the cross section area ratio of the groove 20 specified in the expression (1) given above allows a large decrease in the spin amount of a ball to be avoided in the rain or a shot in the rough. In this embodiment, the grooved area ratio of the groove 20 given above is set equal to or more than 35%, and the cross section area ratio of the groove 20 given above is set equal to or more than 70%.

<Striation 30>

With reference to FIGS. 1 and 2, each striation 30 is of a significantly small form according to the embodiment, being smaller in cross section area than the score line groove 20. In the embodiment, each striation 30 forms a circular arc, and is shaped so as not to overlap any other striation 30. Also in the embodiment, each striation 30 is an arc of radius identical to every other striation 30. Whereas a plurality of the striations 30, formed by milling, were adopted as the traces in the face 10 in the embodiment, the shape of the trace is not limited thereto, and a variety of shapes may be so adopted.

An arrow d0 in FIG. 1 depicts an arrangement direction of the plurality of striations 30. In the embodiment, each striation 30 is an arc of radius identical to every other striation 30 as described above. The arrangement direction d0 is defined as the direction that passes through the center of the circle of arc of each striation 30. An angle θ0, which is formed by the arrangement direction d0 and the lengthwise direction of the score line groove 20, is between 40 and 70 degrees, inclusive, as measured clockwise from the toe side end of the score line groove 20. With regard to the striations 30 depicted in FIG. 1, the angle θ0 is approximately 45 degrees.

Figure 4:
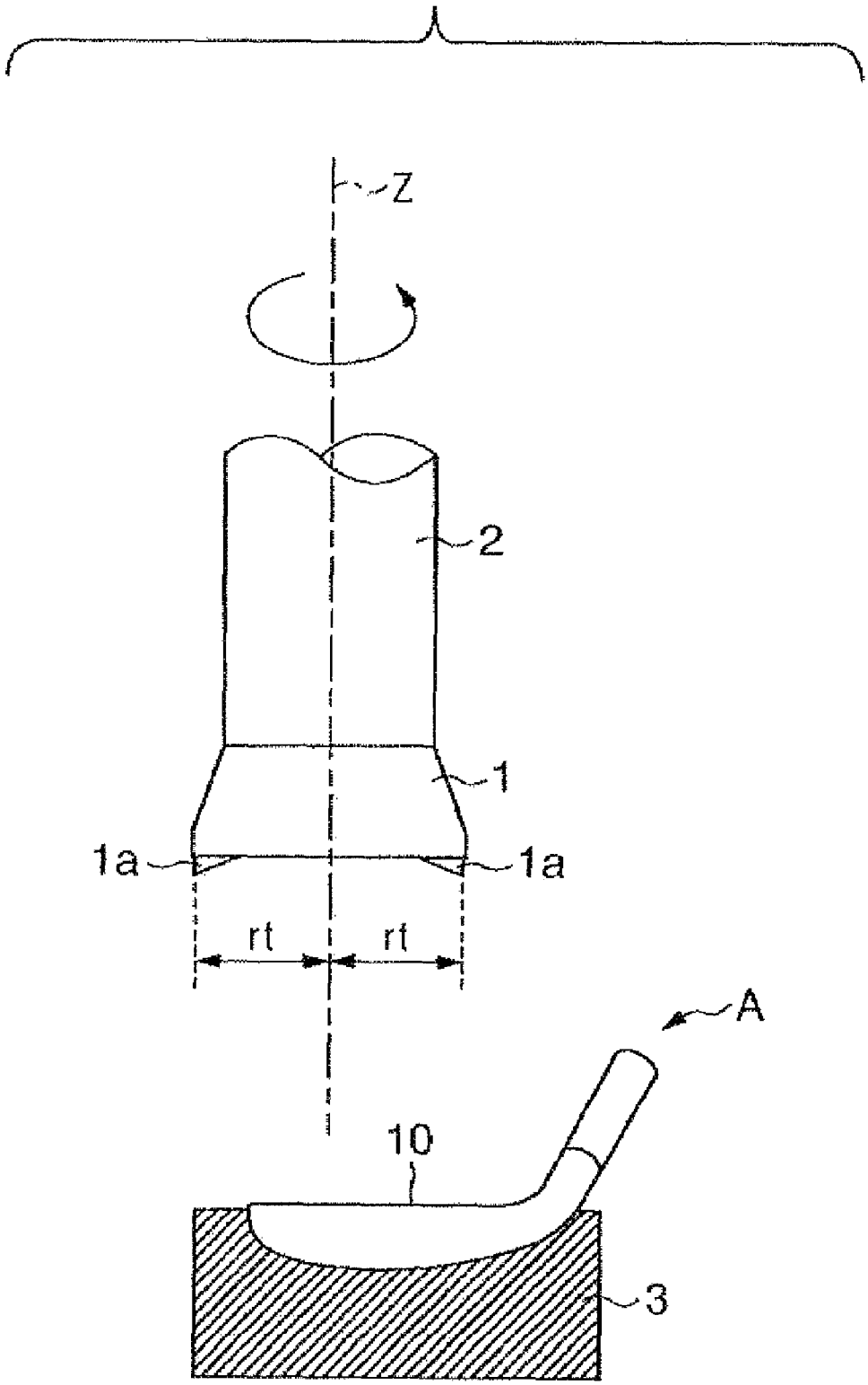
FIG. 4 is a schematic diagram illustrative of a forming method of striations 30 using a milling machine.

The milling for forming the striations 30 may be performed using a milling machine, for example. FIG. 4 is a schematic diagram illustrative of a forming method of striations 30 using a milling machine. The milling machine comprises a spindle 2 that rotates about a vertical axis Z, and a cutting tool (endmill) 1 is attached to the lower end of the spindle 2. A golf club head A, that has not been formed with the striations 30, fixed with the milling machine by way of a jig 3 so that the face 10 is horizontal. A cutting portion 1*a* of the cutting tool is separated from the vertical axis Z by a distance rt, which is the radius of the circle of arc of each striation 30.

Figure 5:
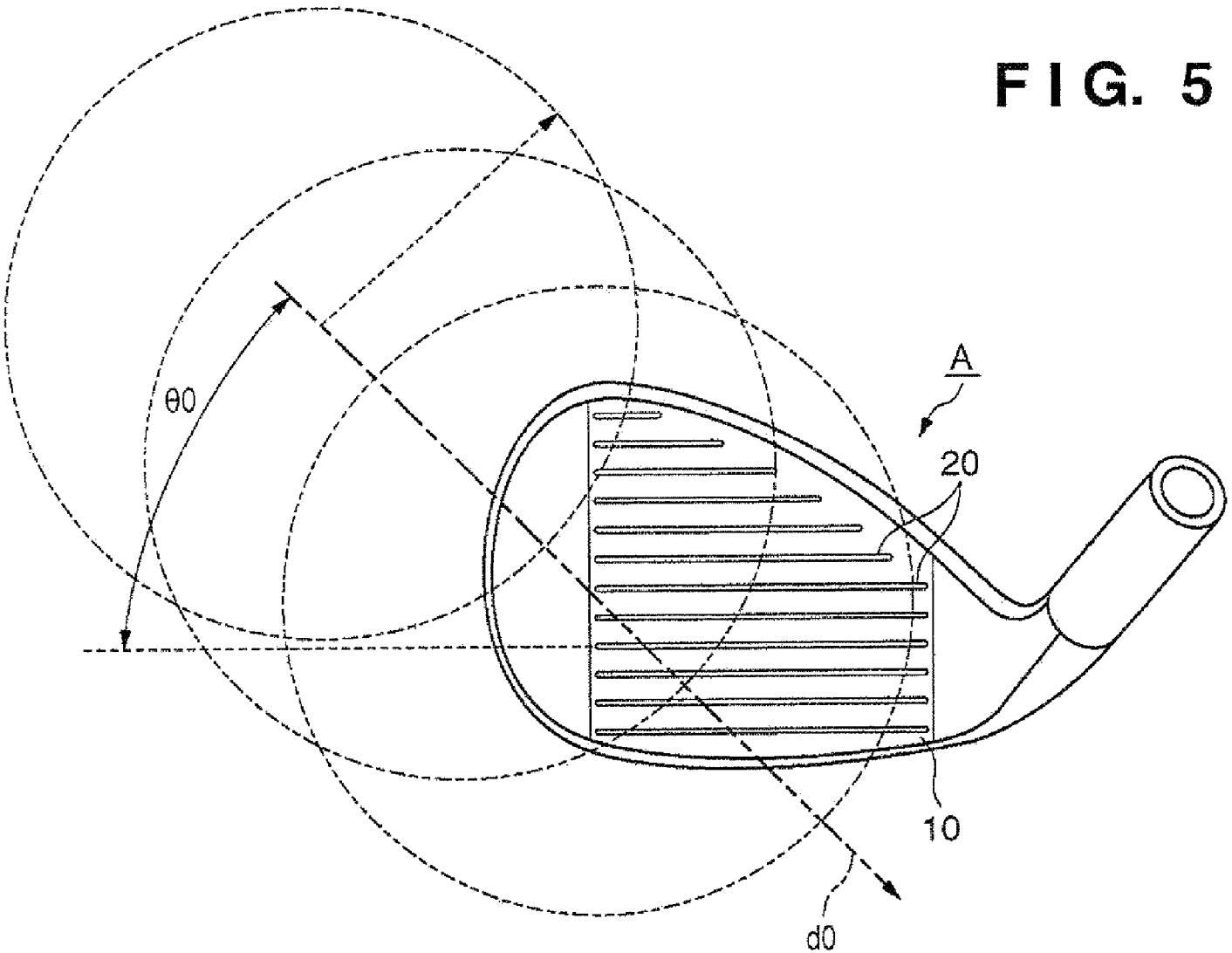
FIG. 5 is a planar view diagram illustrative of a moving path of a cutting tool 1 when milling the striations 30.

FIG. 5. is a planar view diagram illustrative of a moving path of the cutting tool 1 when milling the striations 30. The relative direction of movement, i.e., the horizontal direction, of the cutting tool 1 and the golf club head A, is identical with the arrangement direction d0 of the striations 30. As the cutting tool 1 is moved in the arrangement direction d0, relative to the golf club head A, the plurality of striations 30 is formed by milling the face 10 with the cutting tool 1. The center of the circle arc of each striation 30, or in other words, the position of the vertical axis Z, passes through the arrangement direction d0. Accordingly, the arrangement direction d0 is the direction that passes through the center of the circle arc of each striation 30. The depth, width, and pitch of each striation 30 is adjusted by the depth of the cut into the face 10 by the cutting tool 1 and the relative moving speed of the cutting tool 1.

The face 10 face is formed so as to have the arithmetic mean deviation of the profile (Ra) of not less than 4.00 μm by such milling in the embodiment. By forming the face 10 with the arithmetic mean deviation of the profile (Ra) of not less than 4.00 μm, the surface roughness of the face 10 increases compared to giving the face 10 a mirrored finish. Increased surface roughness of the face 10 improves friction between the ball and the face 10, which makes it easier to impart spin to the ball, nevertheless the ball is shot from the rough. The greater the surface roughness of the face 10, the easier it is to impart spin to the ball, and the more likely the ball is to be damaged.

Accordingly, it is preferable for the surface roughness of the portion of the face 10 that forms the striations 30 to have the arithmetic mean deviation of the profile (Ra) of between 4.00 μm and 4.57 μm, inclusive. It is also preferable for the maximum height of the profile (Ry) to be not greater than 25 μm. Keeping the surface roughness of the face 10 within the specified range of values also meets the regulations pertaining to the surface roughness of the face of a golf club head to be used in official competition golf.

As the angle θ1 of the score line groove 20 decreases, the spin amount of the ball increases. In this case, however, the edges 24 of the score line grooves 20 become sharp, and the ball is easily damaged. Although rounding the edges 24 of the score line grooves 20 prevents damage to the ball, the spin amount of the ball decreases. On the other hand, the arithmetic mean deviation of the profile (Ra) of the face 10 of not less than 4.00 μm improves the spin amount on the ball, nevertheless the ball is shot from the rough. Therefore, when the surface roughness of the face 10 is set 4.00 μm or more in arithmetic mean deviation of the profile (Ra), it is possible to prevent a decrease in the spin amount of the ball that occurs when the angle θ1 of the score line grooves 20 is increased and a decrease in the spin amount of the ball that occurs when the edges 24 of the score line grooves 20 are rounded.

Particularly, when the cross section area ratio of the score line grooves 20 falls within the range of the above-described values, drainage of the face 10 improves, and grass or dust sandwiched between the face 10 and the ball can readily escape into the score line grooves 20. Accordingly, in the rain or a shot in the rough, the friction coefficient of the face 10 does not largely decrease, and spin can be easily imparted to the ball. Therefore, the difference in the spin amount of the ball in different cases, that is, a case of a shot in the fairway in a fine day and a case of a rainy day or a shot in the rough, can be decreased.

Figure 6A:
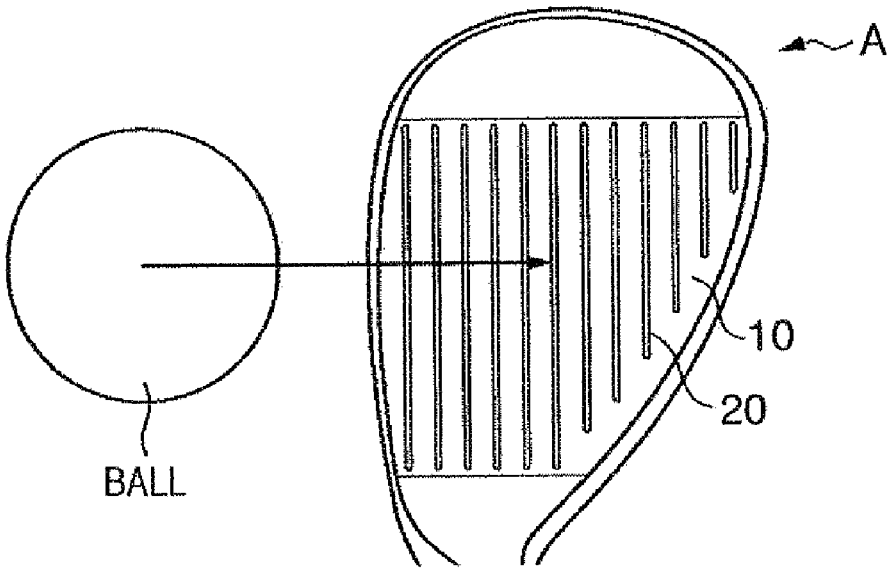
FIG. 6A depicts a face 10 when directly facing in the target direction.
Figure 6B:
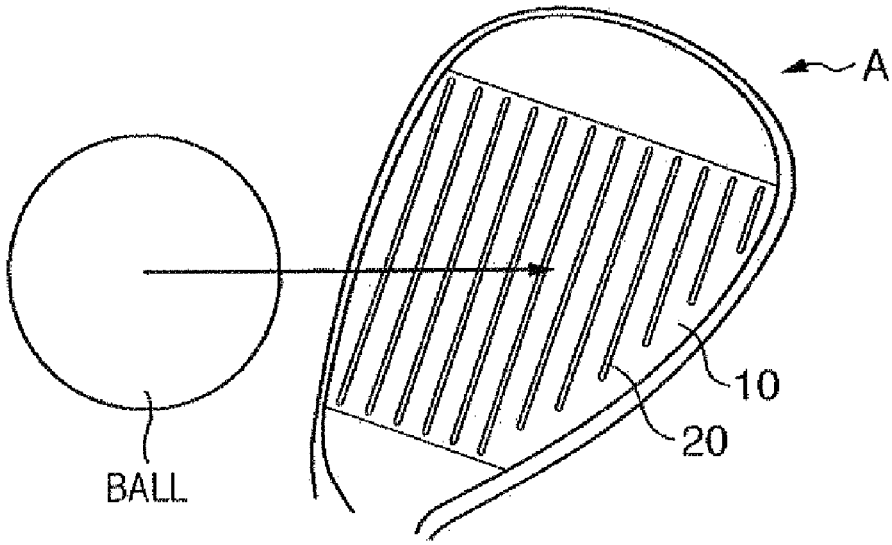
FIG. 6B depicts the face 10 when opened.

Next, in the embodiment, since the angle θ0, which is formed from the arrangement direction d0 of the plurality of striations 30 and the score line groove 20, is between 40 degrees and 70 degrees, inclusive, it becomes easier to impart spin to the ball, allowing obtaining a greater spin amount when using a golf club with the golf club head A when the face 10 is opened, as described in FIGS. 6A and 6B.

FIG. 6A depicts a situation wherein the face 10 is facing directly in the target direction, and FIG. 6B depicts a situation wherein the face 10 is opened. The striations 30 have been omitted from FIGS. 6A and 6B. The arrows in FIGS. 6A and 6B depict the direction of relative movement of the ball vis-a-vis the face 10 at time of impact.

In the embodiment, applying the plurality of striations 30 makes it easier to impart spin to the ball in both the situation shown in FIG. 6A and FIG. 6B. If the face 10 is opened, as depicted in FIG. 6B, results in the ball rubbing against the face 10 at time of impact in such a manner as to intersect the score line grooves 20 at an angle.

Presuming the angle θ0, which is formed by the arrangement direction d0 of the plurality of the striations 30 and the score line grooves 20, to be between 40 and 70 degrees, according to the embodiment, the number of striations 30 that rub against the ball is increased when the face 10 is opened, as depicted in FIG. 6B. To put it another way, the angle of the direction of relative movement of the ball and the striations 30 approaches a right angle. Accordingly, it becomes easier to impart spin to the ball, allowing obtaining a greater spin amount.

Figure 7:
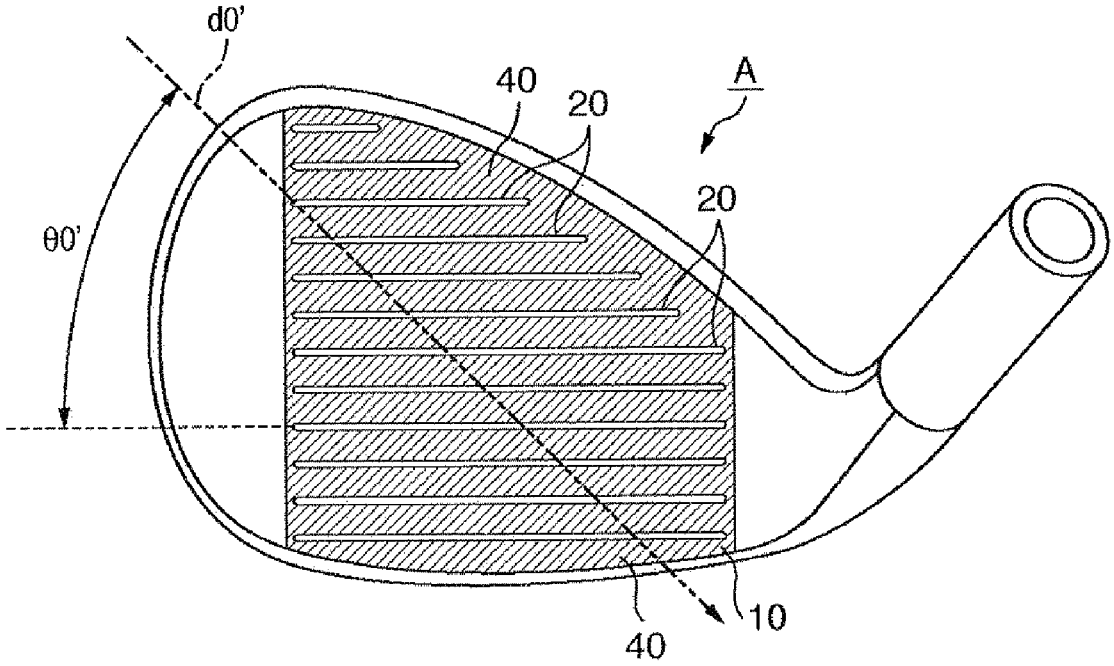
FIG. 7 depicts another example of striations.

While each striation 30 has been formed as a circular arc according to the embodiment, it is possible to form the striations 30 as a straight line as well. FIG. 7 is an external view of an example of a golf club head B with striations in a different shape. The example shown in FIG. 7 is the same as in FIG. 1 except that a plurality of striations 40 are formed of straight lines.

The plurality of striations 40 are mutually formed in parallel. When each striation 40 is straight lines, according to the embodiment, an arrangement direction d0' is defined as a direction that is orthogonal to each striation 40. An angle θ0' formed from the arrangement direction d0' and the lengthwise direction of the score line groove 20 is between 40 and 70 degrees, inclusive, as measured clockwise from the toe side end of the score line groove 20.

Even if the striations 40 have a straight line shape, it is easier to impart spin to the ball, and it is particularly easier to impart spin to the ball when the face 10 is opened, making it easier to obtain a greater spin amount on the ball in either case.

<Evaluation Test of Score Line Groove>

FIG. 8 is a table showing the test results obtained by measuring the degrees of damage (scratches) and spin amount of the balls for golf club heads #1 to #7 and #11 to #15 having different specifications of the score line grooves. All golf club heads are sand wedges with a loft angle of 56°. No milling is performed on their faces.

The test was performed by hitting unused balls with a robot machine using golf clubs (sand wedge) respectively mounted with golf club heads #1 to #7 and #11 to #15. The head speed of the sand wedge is 40 m/s. Also, taking cases of shots in clear weather and cases of shots in the rain or in the rough into consideration, for the dry face (dry) and for the face covered with a thin wet paper (wet), ten balls were hit, respectively.

In FIG. 8, "specifications of score line grooves" shows the specifications of the score line grooves of respective golf club heads #1 to #7 and #11 to #15. All golf club heads #1 to #7 and #11 to #15 have the score line grooves with a trapezoidal cross section as shown in FIG. 2. "Angle θ1" indicates the angle (angle θ1 in FIG. 2) between the side surfaces of the score line groove. "Rounding radius" indicates the radius of rounding formed in the edge of the score line groove. Golf club heads #1 to #3 have no rounding on the edges of the score line grooves. "Width W" indicates the width of the score line groove measured with rounding, as described with reference to FIG. 3A. "Rule-based width Wr" indicates the width of the score line groove measured by the 30 degrees measurement rule.

"Width Ws between grooves" indicates the width Ws described with reference to FIG. 2A. "Pitch" indicates the distance between center lines (center line CL in FIG. 2) of the score line grooves. "Grooved area ratio" indicates the grooved area ratio calculated using the above-described equation (2). The depth D indicates the distance from the face to the bottom surface of the score line groove. "Cross section area S" indicates the cross section area of the score line groove. "Cross section area ratio" indicates the cross section area ratio calculated using the above-described equation (1).

In "test results", "degree of scratches" was evaluated in 1-to-10 scale by the three persons who observed visually and tactilely the degree of damage incurred on the surface of a ball after hitting in the case of the dry face. In this test, "10" was assigned to the largest degree of damage incurred on the surface of the ball and "1" was assigned to the smallest degree of damage. "Spin Amount" was derived from change in the position of an indicator marked in advance on the surface of a ball measured by video recording of the ball upon impact. The spin amount is an average value of ten shots, for the dry and for the wet, respectively.

"Rule conformance" indicates whether each of golf club heads #1 to #7 and #11 to #15 conforms to the rules concerning a golf club head for competitions. Only golf club head #3 does not conform to the rules in terms of a pitch of the score line grooves.

Figure 9A:
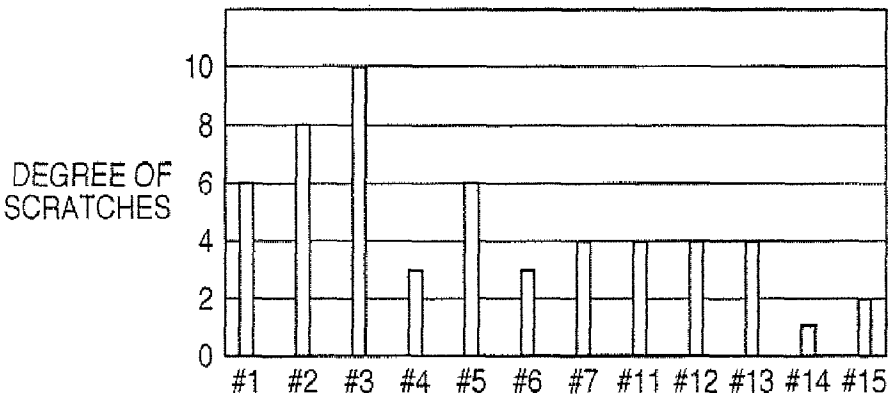
FIGS. 9A to 9C are graphs showing the test results of golf club heads #1 to #7 and #11 to #15.
Figure 9C:
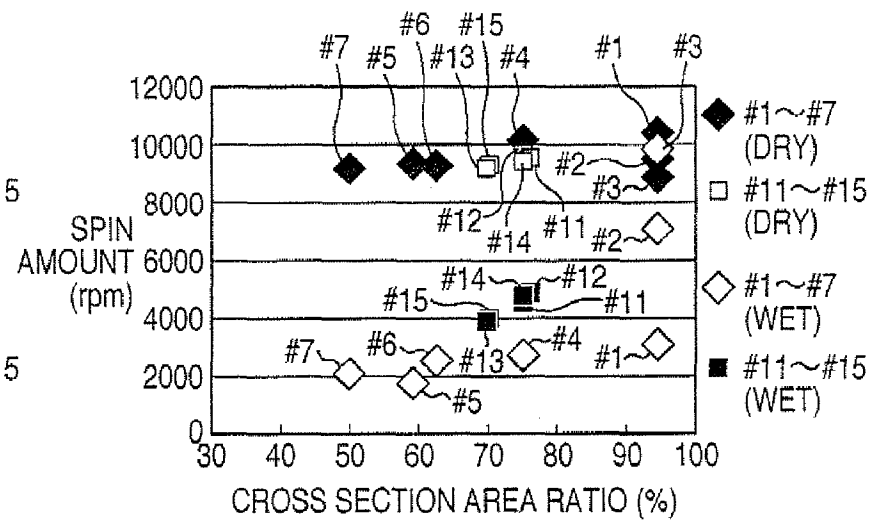
Figure 9B:
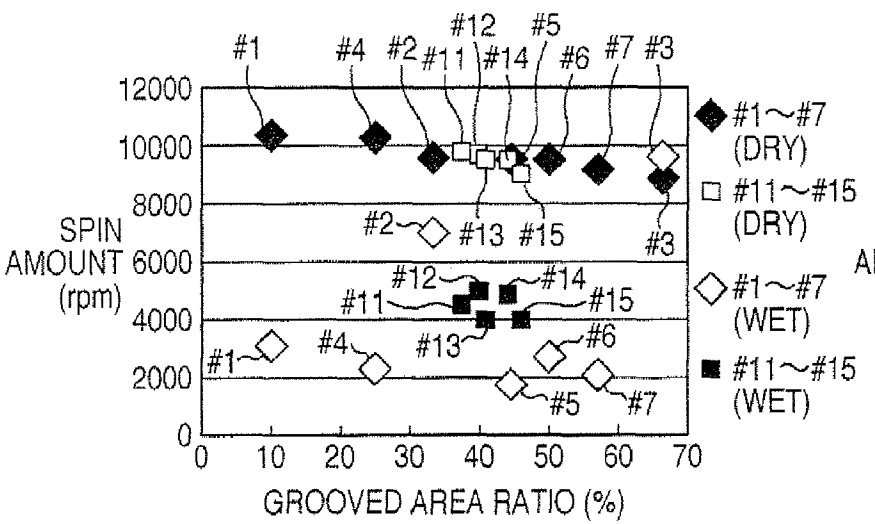

FIG. 9A is a bar graph showing "degree of scratches" of the test results shown in FIG. 8. FIG. 9B is a graph showing the "grooved area ratio"—"spin amount" relationship of the test results for dry and wet shown in FIG. 8. FIG. 9C is a graph showing the "section area ratio"—"spin amount" relationship of the test results for dry and wet shown in FIG. 8.

When "degree of scratches" is considered, golf club heads #1 to #3, each of which has a small angle θ1 and no rounding in the edges of the grooves, have the large degrees of scratches. Hence, rounding the edges of the score line grooves is effective in preventing ball damage.

When "spin amount" is considered, golf club heads #2 and #3 have a large spin amount even when they are wet. More specifically, the spin amount of golf club head #3 for wet is larger than that for dry. However, since golf club heads #2 and #3 each have the large "degree of scratches" as described above, they are not suitable for practical use.

Among golf club heads #1 and #4, although "cross section area ratio" is relatively large (more than 70% in either case), the spin amount for dry is largely different from that for wet. This is because of the small "grooved area ratio" (10% and 25% for heads #1 and #4, respectively). "Grooved area ratio" of golf club head #11 is minimum (38%) among golf club heads #11 to #15, but the decrease in the spin amount of head #11 for wet is smaller than those of heads #1 and #4.

Among golf club heads #5 to #7, "grooved area ratio" is relatively large, but the spin amount for wet is largely different from that for dry. This is because of the small "cross section area ratio" (59%, 63%, and 50% for heads #5, #6, and #7, respectively). Golf club heads #13 and #15 have the lowest "cross section area ratio" (70%) among golf club heads #11 to #15, but the decreases in the spin amount for heads #13 and #15 for wet are smaller than those of heads #5 to #7.

In consideration of the above-described test results, the spin amount for wet can be improved by balancing "grooved area ratio" with "cross section area ratio". In consideration of "grooved area ratio" and "cross section area ratio" of golf club heads #11 to #15, when "grooved area ratio" is 35% or more and "cross section area ratio" is 70% or more, a golf club whose decrease in the spin amount for wet is small can be obtained.

Note that when the golf club head according to the present invention is used for competitions, the rule-based width Wr must be 0.9 (mm) or less. However, when the rule-based width Wr is excessively small, the cross section area of the groove also narrows. Golf club head #13 has the rule-based width Wr of 0.6 (mm), but its spin amount for wet does not largely decrease as compared to golf club heads #11, #12, #14 and #15. Hence, the rule-based width Wr of the score line grooves of the golf club head of the present invention is preferably 0.6 (mm) to 0.9 (mm) (both inclusive).

<Evaluation Test of Striation>

FIG. 10 is a table showing the test results obtained by measuring the spin amount of the ball for golf club heads #21, #22, and #31 to #37 having different specifications of the striations. All golf club heads #21, #22, and #31 to #37 are sand wedges with a loft angle of 56°. The circular arc striations 30 shown in FIG. 1 were formed on their faces by milling. All golf club heads have the same specifications of the score line grooves with a trapezoidal sectional shape, as shown in FIG. 2.

For all golf club heads #21, #22, and #31 to #37, a cutting tool with a radius (rt in FIG. 4) of 37.5 mm was used to form the striations 30 by milling.

In FIG. 10, "θ0" indicating θ0 shown in FIG. 1 is an angle between the arrangement direction (d0 in FIG. 1) of the striations 30 and the score line groove. "Ra" represents the actual measurement value of the surface roughness (the arithmetic mean deviation of the profile) of the face with the striations.

In FIG. 10, "spin amount" indicates the spin amount of the ball. The spin amount is calculated by marking the ball prior to the shot, and using a video camera to track the change in the location of the mark at time of impact.

The test was performed by hitting balls from rough to a target 40 yards ahead by three testers using golf clubs respectively mounted with golf club heads #21, #22, and #31 to #37. The three testers each hit five balls for a case wherein the face was set perpendicularly to the target direction and five balls for a case wherein the face was open. Note that the open angle of the face was freely set by each tester.

Of "spin amount" shown in FIG. 10, "normal" indicates the average value of spin amount of the ball when the faces were set perpendicularly to the target direction, and "open" indicates the average value of the spin amount of the ball when the faces were open.

Figure 11A:
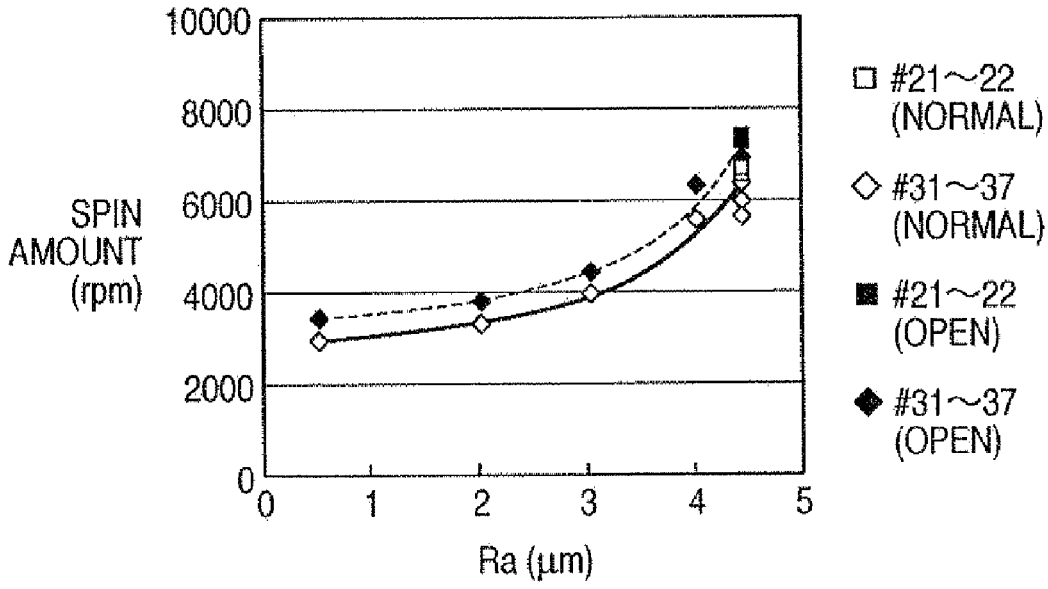
FIG. 11A is a graph showing the "spin amount"—"Ra" relationship of the test results shown in FIG. 10.

FIG. 11A is a graph showing the "spin amount"—"Ra" relationship of the test results shown in FIG. 10. In both "normal" and "open", the spin amount of the ball increases as the surface roughness of the face increases. Since the slope of the plot line increases from the vicinity of "Ra" of 4 μm, that is, the spin amount particularly increases, the surface roughness "Ra" of the face is desirably 4 μm or more. Note that, as described above, as the surface roughness of the face increases, the ball is damaged more easily. Also, there is the rule about the surface roughness of the face of a golf club head for official competitions. In consideration of these points, the surface roughness "Ra" of the face is desirably 4.00 μm to 4.57 μm (both inclusive).

Figure 11B:
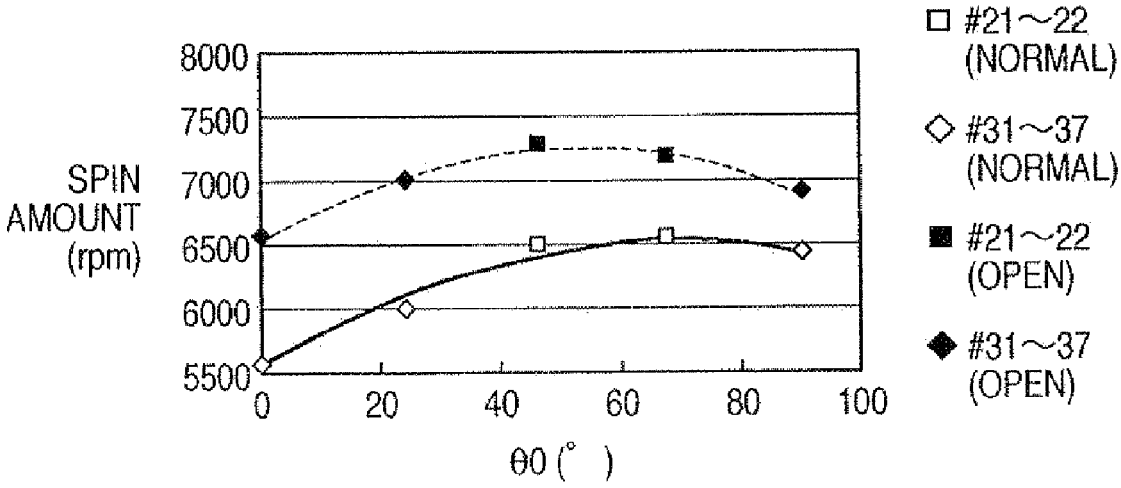
FIG. 11B is a graph showing the "spin amount"—"θ0" relationship of the test results shown in FIG. 10.

FIG. 11B is a graph showing the "spin amount"—"θ0" relationship of the test results of golf club heads #21, #22, and #35 to #37 shown in FIG. 10. Note that golf club heads #21, #22, and #35 to #37 have the faces with the same surface roughness (Ra: 4.4 μm).

In both "normal" and "open", the spin amount increases within the θ0 range of 0° to about 55°. When θ0 exceeds about 55°, the spin amount decreases. In the range of θ0 falling within about 30° to about 80° centered on 55°, the spin amount of 7000 rpm or more can be obtained for "open". Therefore, when θ0 falls within 40° to 70° (both inclusive), the sufficient spin amount of the ball can be obtained for "open".

EXAMPLES

The evaluation test of the spin amount of the ball was performed for the example according to the present invention and comparative examples. FIG. 12A is a table showing the specifications of the example according to the present invention and Comparative Examples 1 to 3, and FIG. 12B is a table showing the test results of the example according to the present invention and Comparative Examples 1 to 3. The example and Comparative Examples 1 to 3 are sand wedges with a loft angle of 56°.

In FIG. 12A, the meanings of the respective items of "specifications of score line grooves" are the same as in FIG. 8. The score line grooves of the example and Comparative Examples 1 to 3 have the sectional shape (trapezoid) shown in FIG. 2.

In FIG. 12A, "milling" indicates whether or not the face underwent milling. The circular arc striations 30 shown in FIG. 1 were formed on the faces of the example and Comparative Example 2 by milling. Upon forming the striations 30 by milling, a cutting tool with a radius (rt in FIG. 5) of 37.5 mm was used. The faces of Comparative Examples 1 and 3 underwent no milling. "Ra" represents the actual measurement value of the surface roughness (the arithmetic mean deviation of the profile) of the face with the striations among the example and Comparative Example 2 in FIG. 12A.

In summary, Comparative Examples 1 and 2 have the same "specifications of score line grooves", but have different surface roughnesses of the faces. Comparative Example 3 and the example have the same specifications of the individual score line groove, but have different array relationships between the score line grooves, more specifically, different grooved area ratios and different surface roughnesses of the faces. Comparative Example 2 and the example have the faces with the same surface roughness, but have different "specifications of score line grooves".

The test was performed by hitting balls from rough to a target 40 yards ahead by three testers using golf clubs respectively mounted with the golf club heads of the example and Comparative Examples 1 to 3. The three testers each hit five balls from each of fairway and rough.

In FIG. 12B, "degree of scratches" was determined as follows. For a shot from fairway, the three testers observed the degree of scratches of the surface of the shot ball by viewing and touching it, and rated the degree of scraches in four levels. In the order of ×→Δ→○→◎, the surface roughness of the ball decreases.

In FIG. 12B, "spin amount" indicates the spin amount of the ball. The spin amount is calculated by marking the ball prior to the shot, and using a video camera to track the change in the location of the mark at time of impact. In "spin amount" shown in FIG. 12B, "fairway" indicates the average value of the spin amount of the ball shot from fairway, and "rough" indicates the average value of the spin amount of the ball shot from rough.

In consideration of "degree of scratches", the degree of surface roughness of the ball for each of Comparative Example 3 and the example is small, and the degree of roughness of the ball for each of Comparative Examples 1 and 2 is large. This is caused by whether the edges of the score line grooves are rounded or not. The edges of the score line grooves of Comparative Example 3 and the example have roundings (radius of 0.1 mm), but those of Comparative Examples 1 and 2 have no rounding.

In comparison of Comparative Examples 1 and 2, the degree of roughness of the ball for Comparative Example 2 is larger. In comparison of the example and Comparative Example 3, the degree of roughness of the ball for the example is larger. This is caused by whether milling was performed or not.

Figure 13:
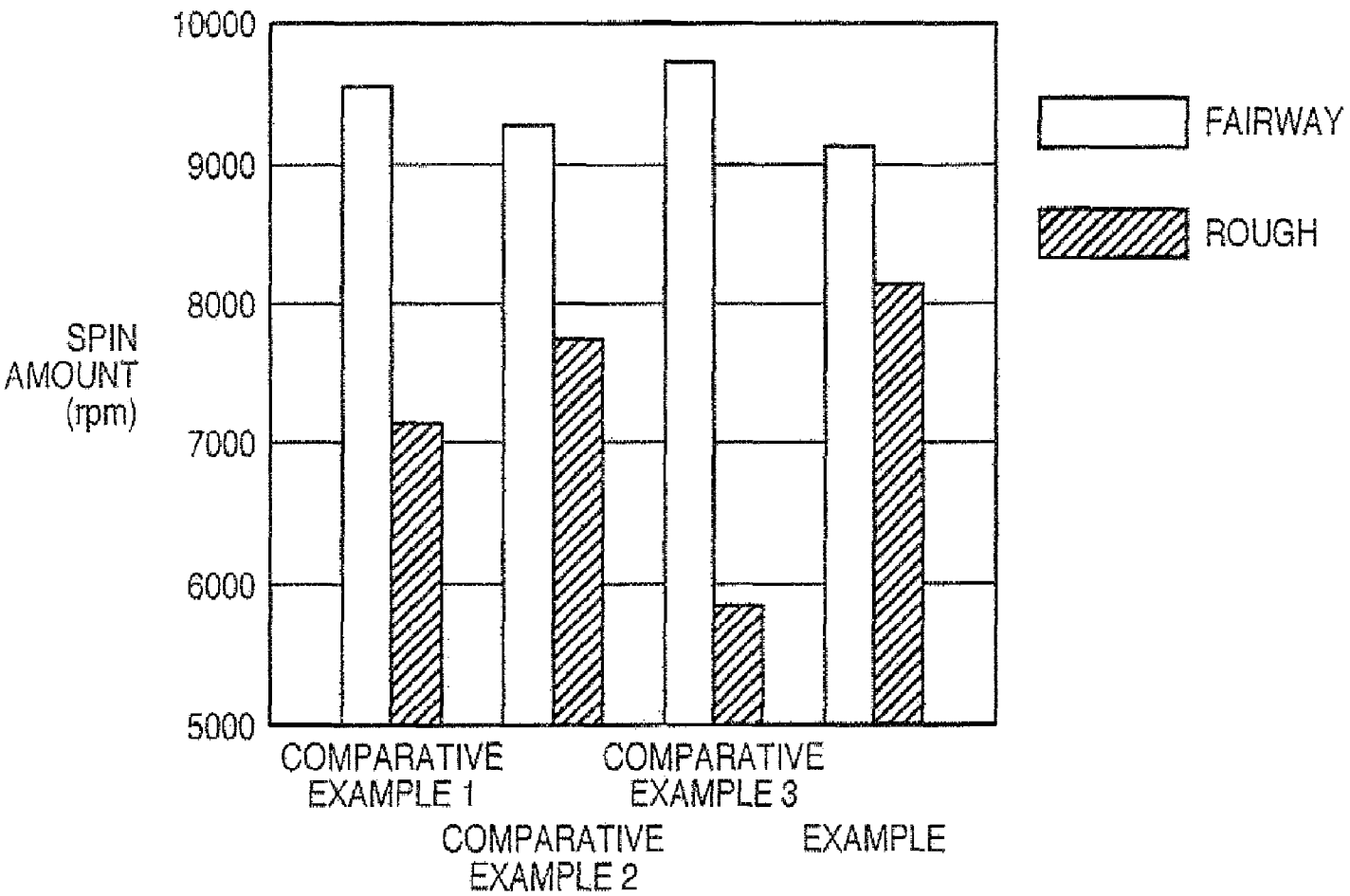
FIG. 13 is a graph showing the spin amount of the test results shown in FIG. 12B.

Now, "spin amount" is considered. FIG. 13 is a graph showing the spin amount of the test results shown in FIG. 12B. There is no great difference in shots from fairway between the example and Comparative Examples 1 to 3. On the other hand, the spin amount is different in shots from rough between them.

Among the example and Comparative Examples 1 to 3, the example has a minimum difference between the spin amount for the shots from fairway and rough. The difference between the spin amount for the shots from fairway and rough in Comparative Example 2 and the example is smaller than that in Comparative Examples 1 and 3. This can be considered as the influence of whether milling was performed or not.

In comparison of the example and Comparative Example 3, the spin amount by a shot from rough is much smaller in Comparative Example 3. This may result from the difference in grooved area ratio. In comparison of the example and Comparative Examples 1 and 2, the example has a maximum spin amount by a shot from rough. This may result from the differences in the grooved area ratio and the cross section area ratio.

A comprehensive evaluation of "degree of scratches" and "spin amount" shows that Comparative Examples 1 and 2 are inferior to Comparative Example 3 and the example in terms of "degree of scratches". Although Comparative Example 3 has the smallest "degree of scratches", the spin amount largely decreases by a shot from rough. Accordingly, the example can be evaluated to be best.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-320751, filed Nov. 28, 2006, which is hereby incorporated by reference herein in its entirety.

What is claimed is:

1. A golf club head comprising:

a face;

a plurality of score line grooves formed on the face; and a plurality of striations formed in the face by milling, wherein edges of each score line groove are rounded with a radius of not more than 0.2 mm, wherein a width W (mm) of the score line groove measured including the rounded edges and a width Ws (mm) representing a distance between adjacent score line grooves satisfy a first expression:

$$S/(Wr\times 0.5)\times 100\geqq 70(\%),\text{ and}$$

wherein a width Wr (mm) of the score line groove measured based on a 30 degrees measurement rule and a cross section area S ($mm^2$) of the score line grooves satisfy a second expression:

$$W/Ws\times 100\geqq 35(\%)$$

wherein the face in which the striations are formed has an arithmetic mean deviation of a profile (Ra) of not less than 4.00 μm, and wherein each striation forms a circular arc, said striations are the only circular arcs on said face, said striations do not intersect with each other on said face, and each score line groove intersects with a plurality of said striations.

2. The golf club head according to claim 1, wherein the face in which the striations are formed has the arithmetic mean deviation of the profile (Ra) of between 4.00 μm and 4.57 μm, inclusive.

3. The golf club head according to claim 1, wherein an angle formed by an arrangement direction of the plurality of striations and the score line groove is between 40 degrees and 70 degrees, inclusive, as viewed clockwise from a toe side end of the score line groove, the arrangement direction is a direction that intersects the center of the circular arc of each striation.

4. The golf club head according to claim 1, wherein the width Wr is not less than 0.6 mm and not more than 0.9 mm.

5. The golf club head according to claim 1, wherein the second expression is $67(\%)W/Ws\times 100\geqq 38(\%)$.

* * * * *